US006330880B1

(12) United States Patent
Okada et al.

(10) Patent No.: US 6,330,880 B1
(45) Date of Patent: Dec. 18, 2001

(54) EXHAUST GAS RECIRCULATION SYSTEM

(75) Inventors: Hidetoshi Okada; Toshihiko Miyake; Sotsuo Miyoshi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/319,513

(22) PCT Filed: Feb. 27, 1998

(86) PCT No.: PCT/JP98/00838

§ 371 Date: Jun. 8, 1999

§ 102(e) Date: Jun. 8, 1999

(87) PCT Pub. No.: WO99/43942

PCT Pub. Date: Sep. 2, 1999

(51) Int. Cl.[7] ..... F02M 25/07
(52) U.S. Cl. ..... 123/568.2; 251/129.07
(58) Field of Search ..... 123/568.2, 568.21, 123/568.26; 251/127.09, 129.11, 129.12, 129.15; 137/601.02, 867, 862, 861

(56) References Cited

U.S. PATENT DOCUMENTS 4,782,811 * 11/1988 Hewette et al. ..... 123/568.24

FOREIGN PATENT DOCUMENTS

19539921C1 2/1927 (DE) .
4338192A1 5/1995 (DE) .
A14338192 5/1995 (DE) .
A6147025 5/1994 (JP) .
A972250 3/1997 (JP) .
A9144611 6/1997 (JP) .
A9189364 7/1997 (JP) .

* cited by examiner

*Primary Examiner*—Andrew M. Dolinar
*Assistant Examiner*—Arnold Castro

(57) ABSTRACT

An exhaust gas recirculation system capable of regulating the degree of valve opening with high accuracy in order to properly recirculate exhaust gas to the combustion chamber (1*a*) of a four-cycle engine (1) for automobiles even in the case of the diesel turbo-type car which usually generates high temperature and pressure exhaust gas. In the exhaust gas recirculation system disclosed herein, two closure valves (19, 20) are provided on the movable shaft (23) so that exhaust gas can flow into a movable space (10*a*) through openings formed by the movement of the two closure valves (19, 20) in their movable range. The pressure effecting on the two closure valves (19, 20) is canceled out and the movement of the movable shaft (23) is not prevented by high pressure of the exhaust gas. Therefore, even in the case of high temperature and pressure exhaust gas of the diesel turbo-type car or like vehicles, the movable shaft can be driven accurately with a relatively small power stepping motor (17).

21 Claims, 9 Drawing Sheets

EXHAUST GAS RECIRCULATION SYSTEM

This application is the national phase under 35 U.S.C. §371 of PCT International Application No. PCT/JP98/00838 which has an International filing date of Feb. 27, 1998 which designated the United States of America.

FIELD OF THE INVENTION

The present invention relates to an exhaust gas re-circulation system for re-circulating exhaust gas from a combustion chamber then back to the combustion chamber. The system is for use in internal combustion engines, such as diesel engines or gasoline engines (for example, lean-burn type engines).

BACKGROUND ART

FIG. 1 is a block diagram showing an example of a conventional exhaust gas re-circulation system using a diaphragm which is employed in the system disclosed, for example, in JP-A-6/147025. In the drawing, reference numeral 1 designates a four-cycle engine for automobiles, powered by the combustion of a gas mixture comprising fuel and air. Numeral 2 denotes an intake pipe line, one end of which is connected to the engine 1 for supplying the gas mixture to the engine 1, and numeral 3 designates an air cleaner connected to the other end of intake line 2 for removing dust contained in the outside air as well as for feeding air to the intake line 2. Numeral 4 shows an injector provided at the middle of the intake line 2 for injecting fuel including gasoline into the intake pipe line, and numeral 5 designates a throttle valve for regulating the amount of the mixed gas to be fed into the engine 1. Further, numeral 6 shows an exhaust pipe line connected to the engine 1 at one end for expelling the gas mixture (exhaust gas) generated by combustion in the engine 1, and numeral 7 denotes a purifying apparatus disposed at the other end of the exhaust line 6 for purifying the exhaust gas with a three way catalyst or the like and for expelling the processed exhaust gas outside. Alternatively, the injector is located at a position designated by numeral 4' when the fuel is injected directly to the combustion chamber or sub-combustion chamber as in the case of a diesel engine.

In addition, numeral 1*a* shows a combustion chamber; 1*b* is an intake valve for closing communication between the intake line 2 and the combustion chamber 1*a*;

1*c* is an exhaust-gas valve for closing communication between the exhaust pipe line 6 and the combustion chamber 1*a*; and 1*d* is a piston which moves vertically in the combustion chamber 1*a*.

Next, the operation of a four-cycle type gasoline engine is described as an example.

Initially, both the intake valve 1*b* and the exhaust-gas valve 1*c* are closed. When the intake valve 1*b* of the four-cycle engine 1 is opened, the piston 1*d* moves down to feed air to combustion chamber 1*a* from the intake line 2 through the cleaner 3. Subsequently the gas mixture mentioned above can be fed into the combustion chamber 1*a* instead of air by appropriately activating the injector 4. At the same time the amount of the gas mixture actually fed into the combustion chamber 1*a* can be regulated by controlling the degree of opening the throttle valve 5. The intake valve 1*b* is then closed, and the piston 1*d* is driven upward to compress the gas mixture. In this manner, the air and fuel contained in the gas mixture react together to produce a combustion gas of high temperature and high pressure in the combustion chamber 1*a*. Then the piston 1*d* is driven downwards by the force of volume expansion due to the combustion of the mixed gas, and the force acting on the piston 1*d* results in the driving force. In this case, combustion may be forcibly induced by use of an ignition plug or like means. Finally, the exhaust-gas valve 1*c* is opened in synchronism with the upward movement of piston 1*d* so that the combustion gas in the combustion chamber 1*a* is expelled outside through the exhaust pipe line 6 and purifying apparatus 7. Thus, the automobile four-cycle engine 1 can output driving force continuously by repetition of the above operation.

In the case of the four-cycle engine 1 for automobiles, when the exhaust gas is discharged from the exhaust line 6, hazardous components, such as nitrogen oxides ($NO_x$), contained in the exhaust gas are eliminated by a chemical such as three way catalyst provided in the purifying apparatus 7.

Next, the above exhaust gas re-circulation system is described.

In FIG. 1, reference numeral 8 denotes an exhaust gas re-circulation system for re-circulating exhaust gas to the intake pipe line under certain conditions; 15 is an exhaust gas intake pipe line for sending the exhaust gas from the exhaust-gas line 6 to the exhaust gas re-circulation system 8; and 16 is an exhaust gas re-circulation pipe line for re-circulating the exhaust gas to be returned from the exhaust gas re-circulation system 8 to the intake pipeline. Further in the exhaust gas re-circulation system 8, numeral 9 designates a housing secured to the exhaust gas intake line 15 and exhaust gas re-circulation line 16; 10 is a re-circulation passage provided in the housing 9 for communication of the exhaust gas intake line 15 with the exhaust gas re-circulation line 16; 13 is a valve seat formed in the housing 9; and 11 is a closure valve for closing the re-circulation passage 10 when in abutment with the valve seat 13. Numeral 12 designates a movable shaft to one end of which is secured the closure valve 11 so that when the shaft 12 is moved in a predetermined direction, the valve 11 is in abutment with or detached from the valve seat 13; 14*c* is a diaphragm fixed to the housing 9 for controlling movement of the movable shaft 12 in a predetermined direction; 14*b* is a spring for biasing the closure valve 11 in the closing direction; 14*a* is a diaphragm chamber for introducing negative pressure; and 14*d* is a check valve for checking the negative pressure.

Next, the operation of re-circulating the exhaust gas is described.

Initially, the closing valve 11 is in abutment with the valve seat 13 to close the re-circulation passage 10. When negative pressure is introduced in the diaphragm chamber 14*a*, the force of the valve opening direction defined by multiplying the negative pressure by the surface area acts on the diaphragm 14*c*. If the force is larger than the biasing force of the spring 14*b* in the valve closing direction, the movable shaft 12 and the closure valve 11 secured to one end thereof displace, whereupon the re-circulation passage 10 communicates with the intake pipe line 2. Thus, the exhaust gas returns into the engine combustion chamber 1*a* through the intake line 2. Consequently, combustion in the automobile four-cycle engine 1 is suppressed by the amount of non-flammable exhaust gas returned to the combustion chamber 1*a*.

The suppression of combustion in the automobile four-cycle engine 1 can further inhibit temperature increases in the combustion gas or the engine even in the case of lean-burn type operation where the mixing ratio of fuel to air is low. Accordingly, increased levels of $NO_x$ associated with temperature increases of the combustion gas or of the engine can be also controlled.

However, conventional exhaust gas re-circulation systems as constituted above have the following problems.

First, when the differential pressure between the intake gas and the exhaust gas of a diesel turbo car or similar type is high, it is necessary to increase the biasing force of spring 14*b* to properly operate the valve against such high differential pressure. Therefore, it is necessary to enlarge the diaphragm 14*c* as well as the system itself. Secondly, negative pressure must be generated to act on the diaphragm 14*c*. In general, in gasoline-type engines, the pressure in the intake pipe line between the throttle valve 5 and the automobile four-cycle engine 1 serves as the source of negative pressure. On the other hand, in diesel engines, the pressure in the brake vacuum pump provided for the automobile brake system is used for negative pressure. Therefore, the system can not be operated in gasoline engines where negative pressure is not generated. Moreover, even if operable, it is difficult to minutely regulate the negative pressure. In diesel engines, the problem arises that negative pressure for brake operation must be used for another purpose (i.e., the exhaust gas re-circulation system). Consequently, it is necessary to set the amount of re-circulated exhaust gas to a sufficiently low level so as not to cause knocking or conspicuous loss of power which will be the result of excessive re-circulation of the exhaust gas. A further problem is that $NO_x$ emissions become difficult to reduce as a result.

We have proposed an exhaust gas re-circulation system, for example, in JP-A7/332168 in which a motor is used in place of the diaphragm. FIG. 2 is a cross-section showing an example of such a conventional exhaust gas re-circulation system using a motor. In the drawing, numeral 17 denotes a stepping motor which is fixed to the housing 9 for controlling movement of the movable shaft 12 along a predetermined direction. The stepping motor has an internally threaded structure for converting rotational movement to linear movement so that the movable shaft 12 is moved vertically when the motor is rotated. Other components are substantially the same as in the diaphragm type exhaust gas re-circulation system of FIG. 1, and therefore are not described but only shown by like reference numerals.

According to the system in FIG. 2, the exhaust gas re-circulating operation can be performed, without the aid of negative pressure, by driving of the closure valve 11 and movable shaft 12 using the stepping motor 17. Moreover, it is possible to downsize the exhaust gas re-circulation system by employing a small sized stepping motor.

However, if the use of the stepping motor 17 is associated with considerably high pressure exhaust gas or increased amounts of returned exhaust gases, an enlargement of the closure valve is needed. Lack of thrust force in the motor may lead to the inability to move the closure valve or other problems. In particular, in diesel turbo-type cars, the maximum pressure of the exhaust gas is as high as 2000 mmHg and requires a very large amount of re-circulated gas flow. However, the above system is totally inoperable in such cases.

In diaphragm-type systems, although the system is tightly closed by the check valve 14*d* to maintain the valve in a preset open state after a desired level of negative pressure has been applied, the pressure of the exhaust gas may be changed by pulsation of the exhaust gas. Therefore, the pressure effecting on the valve is also changed so that the valve slides to change its degree of opening.

The present invention was made to solve the above problems. Therefore, it is an object of the present invention to provide an exhaust gas re-circulation system, in which the closure valve 11 can be easily moved even though a motor is used as a driving mechanism for driving the closure valve 11. Furthermore excellent $NO_x$ emission reduction, superior to that effected by the conventional diaphragm type system, can be obtained even in diesel turbo-type cars or the like vehicles.

DISCLOSURE OF THE INVENTION

A first feature of the exhaust gas re-circulation system according to the present invention is that the system includes a re-circulation system main body which can be disposed in a re-circulation path for exhaust gas, a movable member on which two closure valves are formed, a movable space which is formed inside the re-circulation system main body and in which the movable member is disposed movably, a first re-circulation hole formed so as to communicate with a central portion of the movable space through an outer face of the re-circulation system main body, second re-circulation holes formed to communicate with both ends of the movable space through another outer face of the re-circulation system main body to that of the first re-circulation hole, and two valve seats each of which is in abutment with each of the closure valves when the movable member is located at a preset position in the movable space so as to close communication between the central portion and both end portions of the movable space, wherein a first movable space opening formed by the communication of the first re-circulation hole with the movable space or both second movable space openings formed by the communication of the second re-circulation holes with the movable space are formed outside the movable range of the closing valves in the movable space.

In the exhaust gas re-circulation system of the present invention, the re-circulation hole communicating with the movable space opening disposed outside the movable range of the closure valves in the movable space is connected to the gas exhausting side of the engine, whereby high pressure of the exhaust gas can be effected evenly on the two closure valves irrespective of the position of each closure valve. Therefore, the pressure of the exhaust gas acting on the movable member can be canceled. Accordingly, the movable member can be moved with relatively little power regardless of the exhaust gas pressure over the whole movable range of the movable valves. Thus, the closure valves can be moved with ease even when using a motor as a driving mechanism for the closure valves or when employing the motor in a diesel turbo-type car with high exhaust gas pressure.

A second feature of the exhaust gas re-circulation system according to the present invention is that the system includes a re-circulation system main body which can be disposed in a re-circulation path for exhaust gas, a movable member on which two closure valves are formed, a movable space which is formed inside the re-circulation system main body and in which the movable member is disposed movably, a first re-circulation hole formed to communicate with a central portion of the movable space through an outer face of the re-circulation system main body, second re-circulation holes formed to communicate with both ends of the movable space through another outer face of the re-circulation system main body than that of the first re-circulation hole, and two valve seats each of which is in abutment with each of the closure valves when the movable member is located at a preset position in the movable space so as to close communication between the central portion and both ends of the movable space, wherein each of the two valves is moved in a range which does not overlap with the first movable space opening formed by the communication of the first re-circulation hole with the movable space or both second movable space openings formed by the communication of the second re-circulation hole with the movable space.

In the exhaust gas re-circulation system of the present invention, each re-circulation hole communicating with the movable space opening disposed outside the movable range of the closure valves in the movable space is connected to the gas exhausting side of the engine. As a result, relatively high-pressure exhaust gas can be effected evenly on the two closure valves irrespectively of the position of each closure valve. Therefore, the pressure of the exhaust gas effecting on the movable member can be canceled. Accordingly, the movable member can be moved with little power regardless of the exhaust gas pressure over the whole movable range of the movable valves. Thus, the closure valves can be moved with ease even when using a motor as a driving mechanism for the closure valves and when employing the motor in a diesel turbo-type car with high exhaust gas pressure.

The movable member of the exhaust gas re-circulation system according to the present invention is controlled by a motor.

According to the above exhaust gas re-circulation system, high-pressure exhaust gas can be effected evenly on the two closure valves irrespective of the position of each closure valve, thereby cancelling the pressure of the exhaust gas effecting on the movable member. Accordingly, the movable member can be easily moved over the whole movable range of the movable valves regardless of the exhaust gas pressure. Therefore, the movement of the closure valves in vehicles such as diesel turbo type cars can be minutely controlled so as to obtain a higher $NO_x$ reducing effect as compared to the conventional diaphragm type system.

In one aspect of the exhaust gas re-circulation system according to the present invention, the exhaust gas flows into the system from the first re-circulation hole and the movable member has a movable shaft extending through the gas re-circulation system main body, the two closure valves being fixed on the movable shaft, and a bearing or bearings provided on one or both ends of the movable shaft outside the closure valves.

According to the exhaust gas re-circulation system, the gas exhausting side of the engine can be connected to the first re-circulation hole communicating with the central portion of the movable space, and the bearing or bearings can be disposed opposite the closure valves with respect to the first re-circulation hole, thereby limiting the possibility of contact between the exhaust gas and the movable shaft extending through the re-circulation system main body to those times when gas re-circulating is in operation. Accordingly, dust resulting from the exhaust gas is less apt to remain in the region through which the movable shaft extends in the re-circulation system main body. Thus, the exhaust gas re-circulation system is applicable to long time continuous operation.

In another aspect of the exhaust gas re-circulation system according to the present invention, the re-circulation system main body comprises a housing in which an assembly hole of a size larger than the outer diameters of the two valve seats is formed at one end of the movable space, and an assembly hole closing member for closing the assembly hole. The valve seat nearer to the assembly hole is of a size larger than that of the other valve seat farther from the assembly hole.

According to the exhaust gas re-circulation system, the housing and the two valve seats can be formed in separate bodies, and the gas re-circulation system can be configured by assembling them. The housing can be formed with ease by casting, and the valve seats can be obtained by high accuracy skiving. Thus, relative ease of fabrication of a exhaust gas re-circulation system with a precise valve closing operation can be achieved. Because the two valve seats are assembled after being formed separately from the housing, precise conformity between the internal diameters of the two valve seats can be achieved. It is also possible to make the outer diameters of the two closure valves conform to each other with high accuracy by properly selecting the order of assembling the two seat valves and the two closure valves. Accordingly, the effect of canceling the exhaust gas pressure obtained by the two closure valves can be optimized.

THE BEST MODE FOR CARRYING OUT THE PRESENT INVENTION

Hereinafter, the best mode for carrying out the present invention will be described in detail with reference to the accompanying drawings.

Embodiment 1

Figure 1:
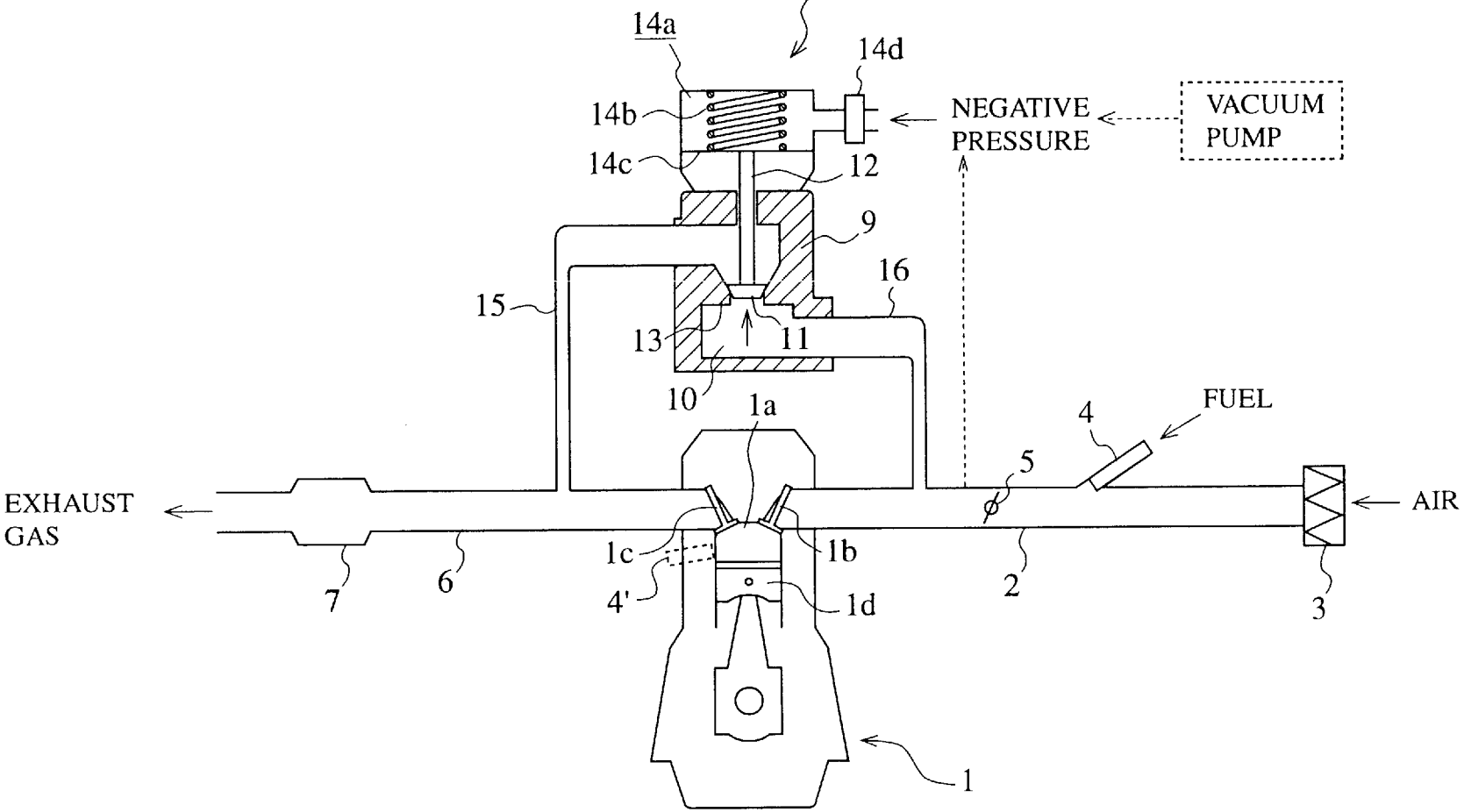
FIG. 1 is a block diagram showing an example of a conventional exhaust gas re-circulation system using a diaphragm.
Figure 2:
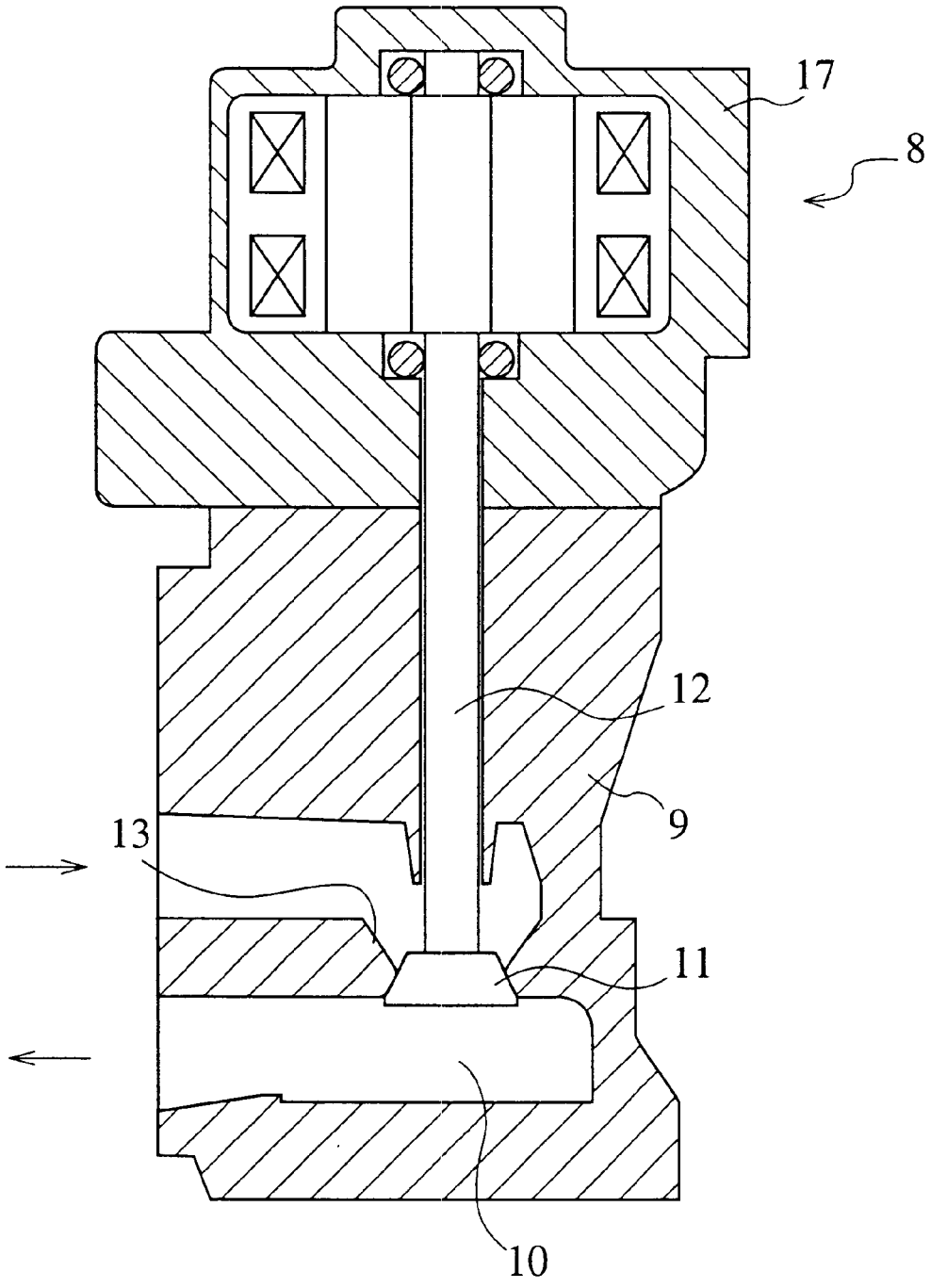
FIG. 2 is a cross-section of an example of a conventional exhaust gas re-circulation system using a motor.
Figure 3:
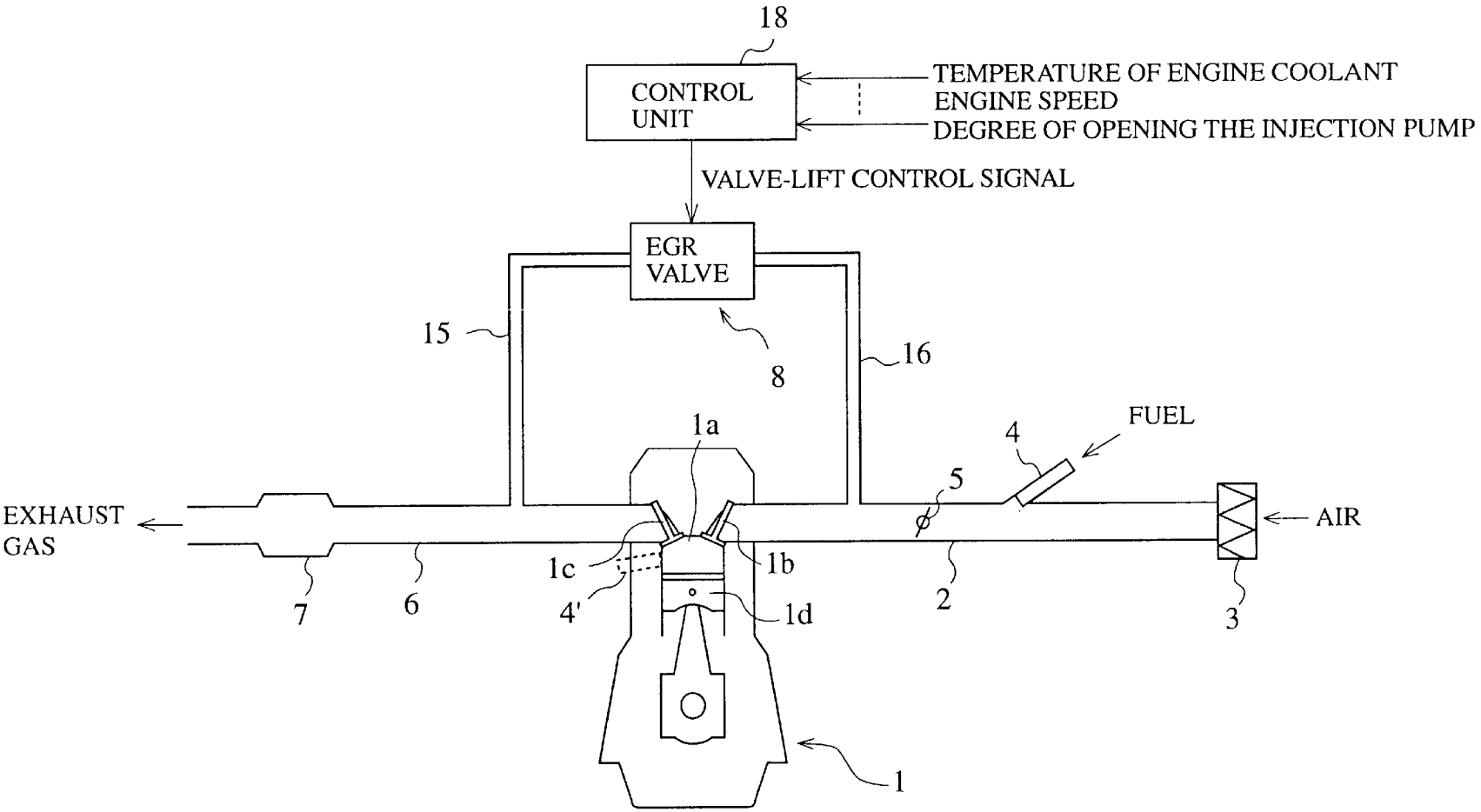
FIG. 3 is a block diagram showing embodiment 1 of the exhaust gas re-circulation system using a motor according to the present invention.

FIG. 3 is a block diagram of embodiment 1 of the exhaust gas re-circulation system according to the present invention, in which system a motor is used. The system according to embodiment 1 relates, in particular, to gasoline or diesel engines. In the drawing, reference numeral 1 designates an automobile four-cycle gasoline engine for generating driving force by combustion of a gas mixture comprised of air and fuel; 2 is an intake pipe line connected to the engine 1 at one end for supplying the gas mixture to engine 1; numeral 3 is an air cleaner connected to the other end of the intake line 2 for providing air to the intake line 2 after eliminating dust or like matter contained in the outside air; 4 is an injector provided at a middle portion of the intake line 2 for injecting gasoline into the intake line 2 (if the fuel is injected directly to the combustion chamber or sub-combustion chamber as in the case of the diesel engine, the injector is located at a position designated by numeral 4'); and numeral 5 is a throttle valve for regulating the amount of the gas mixture to be fed into the engine 1 (in some cases, the throttle valve may not be provided when the engine 1 is a diesel engine). Further, numeral 6 denotes an exhaust pipe line connected to the engine 1 at one end for exhausting a mixed gas (exhaust gas) produced by combustion in the engine 1; 7 is a purifying apparatus disposed at the other end of the exhaust line 6 for purifying the exhaust gas with a three way catalyst or the like and for exhausting the processed exhaust gas outside; 8 is an exhaust gas re-circulation system for exhausting the exhaust gas to be supplied into this system; 15 is an exhaust gas intake pipe line for supplying the exhaust gas from the exhaust-gas line 6 to the exhaust gas re-circulation system 8; 16 is an exhaust gas re-circulation pipe line for returning the exhaust gas from the exhaust gas re-circulation system 8 to the intake line 2 between the throttle valve 5 and the engine 1; and 18 is a control unit for outputting a valve-lift control signal to the exhaust gas re-circulation system 8 in response to the running state. In addition, numeral 1*a* shows a combustion chamber; 1*b* is an intake valve for closing communication between the intake line 2 and the combustion chamber 1*a*; 1*c* is an exhaust-gas valve for closing communication between the exhaust line 6 and the combustion chamber 1*a*; and 1*d* is a piston which moves vertically in the combustion chamber 1*a*.

Figure 4:
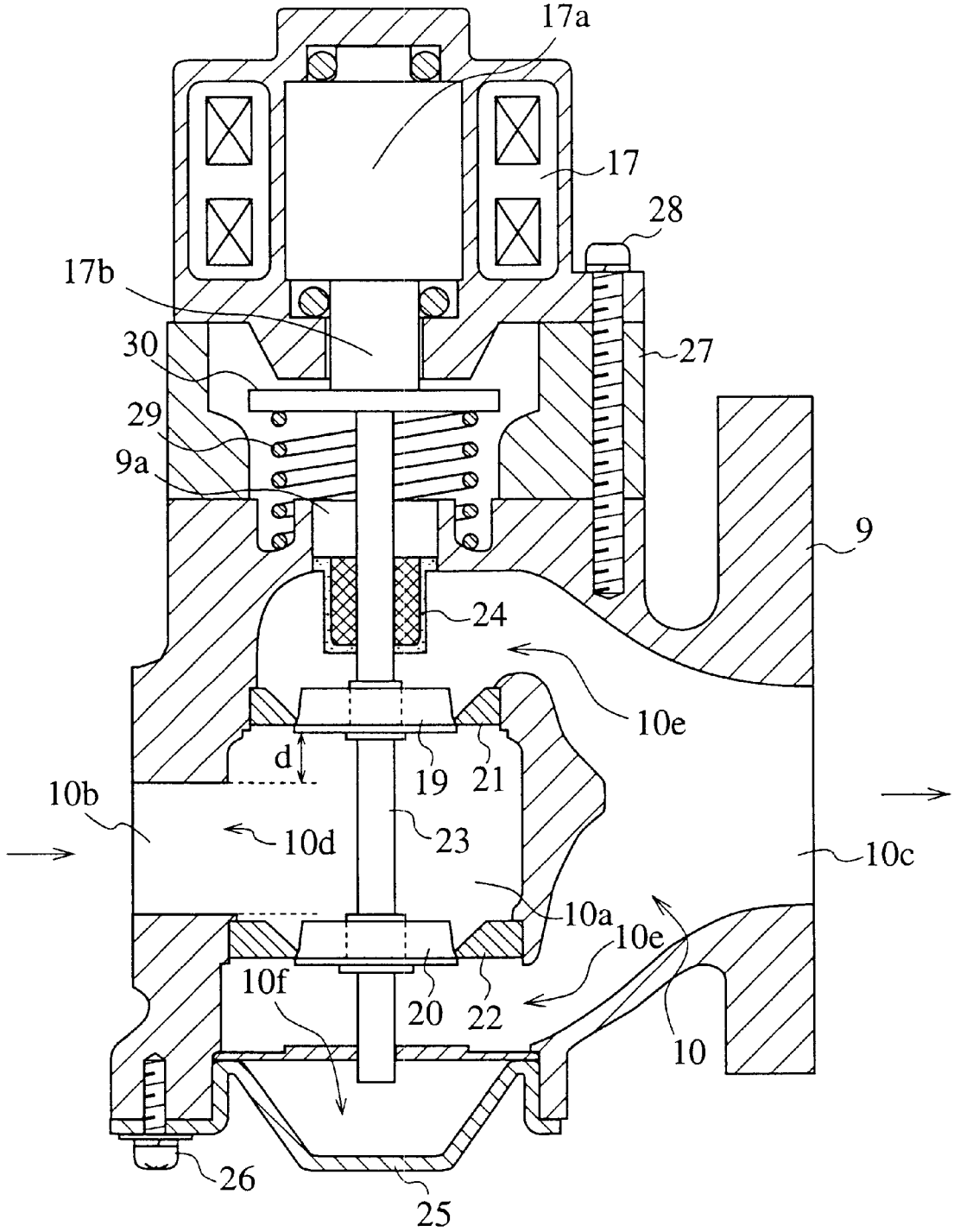
FIG. 4 is a cross-section of embodiment 1 of the exhaust gas re-circulation system using a motor according to the present invention.

FIG. 4 is a cross-section of embodiment 1 of the exhaust gas re-circulation system according to the present invention, in which system a motor is used. In the drawing, numeral 9 designates a housing to which the exhaust gas intake line 15 and exhaust gas re-circulation line 16 are secured; 17 is a stepping motor fixed to the housing 9; and 27 is a spacer disposed between the housing 9 and the stepping motor 17. The stepping motor 17 is fixed together with the spacer 27 to the housing 9 by a screw 28. In addition, numeral 17*a* denotes a rotor of the stepping motor 17.

Reference numeral 10 designates a re-circulation path provided in the housing 9 for communication between the exhaust gas intake line 15 and the exhaust gas re-circulation line 16. The re-circulation path 10 is composed of a movable space 10 *a* having a column-like shape and extending in the axial direction of the rotor 17*a* of the stepping motor, an inlet hole 10*b* formed in one side of the housing 9 to which the exhaust gas intake line 15 is connected so that the inlet hole communicates with the central portion of the movable space 10*a*, and an outlet hole 10*c* formed in the other side of the housing 9 to which the exhaust gas re-circulation line 16 is connected so that the inlet hole communicates with both ends of the movable space 10*a*. Further, numeral 10*d* shows an inlet opening formed in the central part of a side of the movable space 10*a* for communication between the inlet hole 10*b* and the movable space 10*a*, and 10*e* shows outlet openings formed in both end sides of the movable space 10*a* for communication between the outlet hole 10*c* and the movable space 10*a*.

Reference numeral 23 denotes a column-like movable shaft connected to the rotor 17*a* of the stepping motor and extending into the movable space 10*a* so as to move in the axial direction of the rotor 17*a* in accordance with movement of the rotor; 9*a* is a through hole provided in the housing 9 and into which the movable shaft 23 is sidably inserted; 24 is a filter member disposed on one side of the through hole 9*a* facing the movable space 10*a* for suppressing flow of the exhaust gas into the through hole 9*a*; 20 is a first disc-like closure valve fixed near a distal end of the movable shaft 23 opposite to the rotor 17*a*; and 19 is a second disc-like closure valve of the same outer diameter as the first closure valve 20, which is fixed on the movable shaft 23 nearer to the rotor 17*a* than the first closure valve 20. Numeral 22 shows a first valve seat fixed to the housing 9 to be in abutment with the first closure valve 20 when the movable shaft 23 is moved toward the rotor 17*a*; 21 is a second valve seat fixed to the housing 9 to be in abutment with the second closure valve 19 when the movable shaft 23 is moved toward the rotor 17*a*. When the two pairs of valve seats 21, 22 and closure valves 19, 20 are in abutment, respectively, the communication between the central portion and both ends of the movable space 10*a* is severed. As a result, the inlet hole 10*b* and outlet hole 10*c* are separated.

Further, numeral 30 designates a spring support seat fixed on the stator side end of the movable shaft 23, and numeral 29 shows a coil spring disposed between the spring support seat 30 and the housing 9 for biasing the closure valves in the valve closing direction Namely, the spring support seat 30 and the movable shaft 23 are biased toward the rotor 17*a* by the coil spring 29. Accordingly, the communication between the central portion and both the ends of the movable space 10*a* is severed when the inlet hole 10*b* and the outlet hole 10*c* are separated and the system is in a stop mode.

Numeral 10*f* shows an assembly hole formed in the housing 9 at one end of the movable space 10*a* opposite to that at which the stepping motor 17 is located; 25 is an assembly hole closing member fitting in the assembly hole 10*f*; and 26 is a screw for securing the assembly hole closing member 25 to the housing 9.

Figure 5:
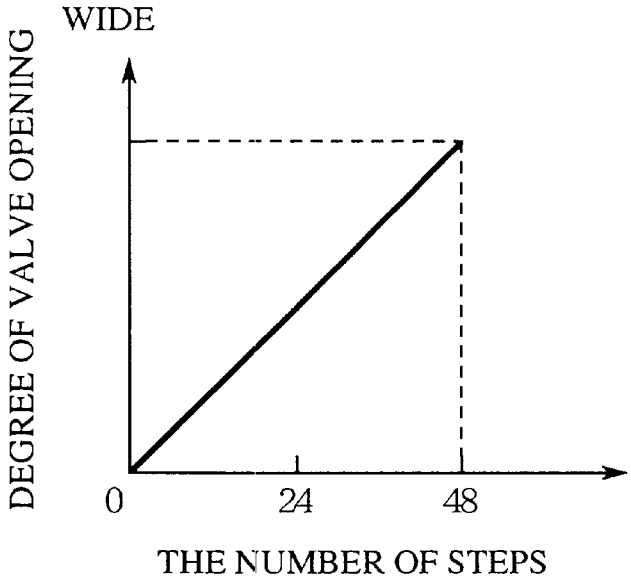
FIG. 5 is a graph showing operational properties under exhaust gas pressure of 2000 mmHg of embodiment 1 of the exhaust gas re-circulation system according to the present invention.

The motor shaft 17*b* of the stepping motor 17 fixed on the housing 9 urges the spring support seat 30 against the biasing force of the spring 29 to move the movable shaft 23 so that the inlet hole 10*b* communicates with the outlet hole 10*c*. When the automobile four-cycle engine 1 is in operative mode, since the pressure of exhaust gas is higher than the pressure of intake gas, the exhaust gas is returned from the exhaust gas pipe 6 to the intake pipe line 2. FIG. 5 is a graph of operational properties of the embodiment 1 showing a relation between the number of steps of the stepping motor 17 and the degree of valve opening. As shown in the drawing, the degree of valve opening increases with the number of steps. Further the amount of returned exhaust gas increases as the degree of valve opening becomes large. The second closure valve 19 does not overlap the inlet opening 10*d* even if the degree of valve opening reaches the 48-th step at which the opening degree is at a maximum.

Next the operation of the exhaust gas re-circulation system is described.

Initially, both the intake valve 1*b* and the exhaust-gas valve 1*c* are closed. When the intake valve 1*b* of the four-cycle engine 1 is opened, the piston 1*d* moves down to feed the air of the intake line 2 from the cleaner 3 into the combustion chamber 1*a*. Subsequently the gas mixture can be fed into the combustion chamber 1*a* instead of air by appropriately operating the injector 4. At the same time the amount of the gas mixture actually fed into the combustion chamber 1*a* can be regulated by controlling the degree of opening of the throttle valve 5. The intake valve 1*b* is then closed, and the piston 1*d* is driven upward to compress the mixed gas. In such a manner, the air and fuel contained in the mixed gas react with each other to produce a combustion gas of high temperature and high pressure in the combustion chamber 1*a*. The piston 1*d* is driven downwards by the force of volume expansion due to the combustion of the gas mixture, and the force acting on the piston 1*d* is outputted as driving force. In this case, the combustion may be forcibly induced by use of an ignition plug or like means. Finally, the exhaust-gas valve 1*c* is opened in synchronism with the re-raised movement of piston 1*d* so that the combustion gas in the combustion chamber 1*a* is exhausted outside through the exhaust line 6 and purifying apparatus 7. Thus, the automobile four-cycle engine 1 can generate driving force continuously by the repetition of the above operation In the engine of this embodiment, hazardous components such as $NO_x$, contained in the exhaust gas are eliminated by a three way catalyst provided in the purifying apparatus 7 on exhausting the exhaust gas outside from the exhaust line 6.

Figure 6:
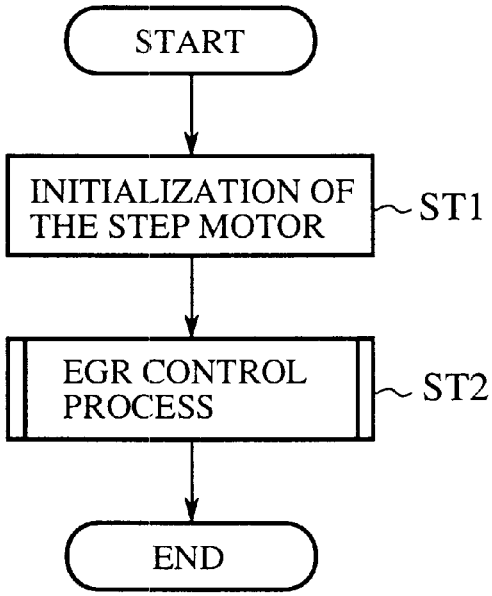
FIG. 6 is a flow chart showing a main control pathway of the embodiment 1 of the exhaust gas re-circulation system according to the present invention.

In the operative cycle of the automobile four-cycle engine 1, the control unit 18 repeatedly performs the main control sequence for re-circulating the exhaust gas, as shown in FIG. 6 for example, in response to the temperature of engine coolant, the number of engine rotations and the degree of opening the injector (amount of fuel injection). In FIG. 6, STI represents a step of an initializing process for determining such factors as the initial position of the stepping motor, and ST2 is a step of exhaust gas re-circulation control process (EGR control process) for generating a valve-lift control signal based on the various conditions mentioned above. The stepping motor 17 rotates by a predetermined number of steps based on the valve-lift control signal to set the degree of valve opening in the exhaust gas re-circulation system 8 to a predetermined level.

Figure 7:
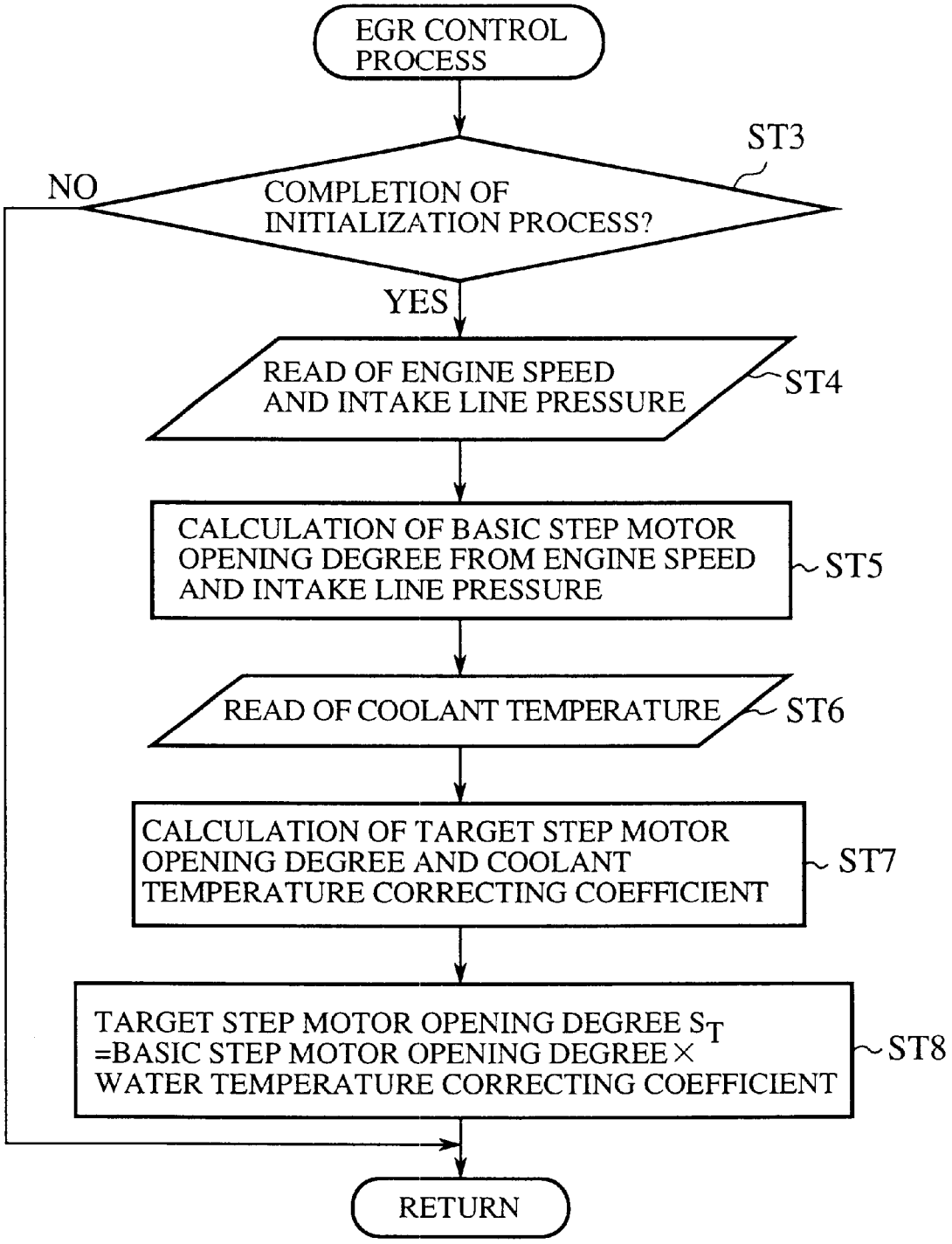
FIG. 7 is a flow chart showing in detail an EGR control process of embodiment 1 of the exhaust gas re-circulation system according to the present invention.

FIG. 7 is a flow chart showing a detailed control procedure of the step ST2 for the EGR control process. In the drawing, ST3 designates a discriminating completion step for the initializing process for determination of whether the initializing process step ST1 is completed or not. If the step ST3 judges that the step ST1 has been completed, the sequence proceeds to step ST4. Otherwise, the EGR control process step ST2 is ended. ST4 represents a reading basic data step for reading the number of engine rotations and the pressure of the intake line; ST5 is a basic opening degree calculation step for calculating the basic valve opening degree based on the number of engine rotations and the intake line pressure on which the step motor is based; ST6 is a correcting data read step for reading the temperature of the engine coolant; ST7 is a target step-motor opening-degree water-temperature correcting coefficient calculating step for calculating a correcting coefficient of valve opening in response to the coolant temperature; and ST8 is a target step-motor opening-degree operation step for obtaining an opening degree of a target valve for the step motor 17 by multiplying the basic valve opening degree by the correcting coefficient. Consequently, the valve-lift control signal is produced based on the target valve opening degree.

In the above procedure, in EGR control process step ST2, for example, when the number of engine rotations is greater than a predetermined number of rotations and the pressure of intake line 2 is low, the valve opening degree is set to a larger value to re-circulate more exhaust gas. It is also possible to set a larger correcting coefficient with increases in the temperature of the engine coolant. Additionally, the valve opening degree can be controlled with high accuracy under open-loop control because of the use of the stepping motor 17. The valve opening degree can be minutely controlled to re-circulate a small amount of exhaust gas even when idling.

Accordingly, the exhaust gas re-circulation system of embodiment 1 can re-circulate exhaust gas to the combustion chamber 1*a* by opening the closure valve of the exhaust gas re-circulation system 8 during operation at ordinary-speeds or when idling. In such a control operation, combustion in the engine 1 can be suppressed by the non-flammable part of the exhaust gas returned into the combustion chamber 1*a*. Therefore, temperature increases attributed to combustion can be suppressed while allowing optimal re-circulation of exhaust gas in any running state, thereby reducing $NO_x$, generation. Further, even when idling, exhaust gas can be re-circulated in optimal amounts in accordance with warming-up conditions of the engine 1. Therefore temperature increases in the combustion gases can be controlled and the $NO_x$ emissions can be reduced.

Because the opening degree of the closure valve is controlled by the stepping motor 17, a great amount of exhaust gas can be re-circulated as long as the efficiency of the engine 1 is not reduced. Thus, the system in embodiment 1 can realize a high efficiency of reducing $NO_x$, emissions that are not attainable for conventional exhaust gas re-circulation systems using a diaphragm.

Moreover, since the second closure valve 19 moves in a range which does not overlap with the inlet opening 10*d*, that is to say, the inlet opening 10*d* is formed to be outside the movable range of the second closure valve 19, the pressure of the exhaust gas can be effected properly to the second closure valve 19 regardless of its position in accordance with the valve opening degree. In other words, the system in embodiment 1 can prevent lateral entering of exhaust gas with respect to the second closure valve, bring the exhaust gas to effect on the whole surface of the second closure valve 19, and ensure pressure application onto the second closure valve 19. On the other hand, the first closure valve 20 is provided on the movable shaft on which the exhaust gas pressure effects in the opposite direction to the second closure valve 19. Therefore, the force effecting on the two closure valves 19, 20 can cancel out the force due to the pressure of exhaust gas preventing movement of shaft 23. In addition, since the force effecting on the two closure valves 19, 20 is stable irrespectively of the valve opening degree, the exhaust gas pressure can effect on the two closure valves 19, 20 evenly in the respectively opposite directions regardless of their degree of opening. Therefore, the movable shaft 23 can be moved with moderate force regardless of the valve opening degree. As a result, even if the exhaust gas re-circulation system 8 is used in a diesel turbo-type car such that the maximum pressure of exhaust gas is around 2000 mmHg, the opening and closing operation of closure valves 19, 20 can be performed by the stepping motor 17 of relatively small output (e.g., 4 kgf output). Even in diesel turbo-type cars, it is possible to obtain higher reductions in $NO_x$, emissions than in the conventional diaphragm-type system.

Because the exhaust gas intake line 15 is connected to the opening 10*b* communicating with central portion of the movable space 10*a* and the communication between the central portion and both ends of the movable space 10*a* is shut off by the two closure valves 19,20 in the stop mode, unnecessary contact of exhaust gas with the through hole 9*a* can be prevented in the stop mode. Accordingly, dust contained in the exhaust gas is less apt to remain in the space between movable shaft 23 and through hole 9*a*, thereby enabling continuous use of the exhaust gas re-circulation system 8 for a long periods without requiring disassembly and cleaning.

Next, a process of manufacturing the exhaust gas re-circulation system is described.

Figure 8A:
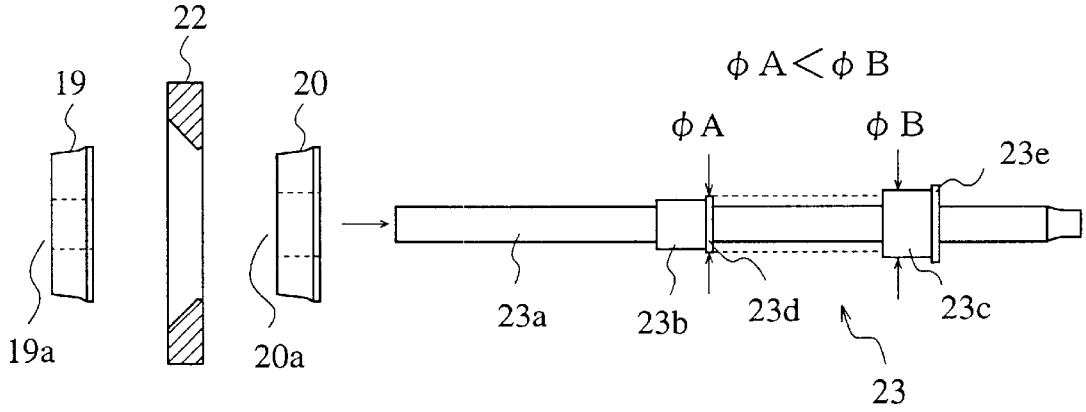
FIG. 8 is a diagram showing a process of assembling a movable member in embodiment 1 according to the present invention.
Figure 8B:
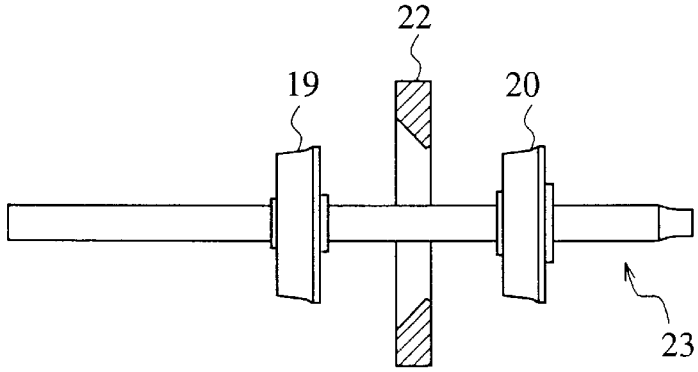

FIG. 8 shows a process of assembling the movable member according to the embodiment 1 of the present invention, in which FIG. 8(*a*) is an exploded view and FIG. 8(*b*) shows completion of the assembly. In the drawings, reference numeral 19*a* designates a second through hole formed in central portion of the second closure valve 19; 20*a* is a through hole formed in central portion of the first closure valve 20 and having a diameter larger than the second through hole 19*a*; 23*a* is a main movable shaft formed in a column-like shape; 23*b* is a second valve support disposed at a middle portion of the main movable shaft 23*a* and having such a size as just to fit in the second through hole 19*a*; 23*c* is a first valve support disposed at one end of the main movable shaft 23*a* and having such a size as just to fit in the first through hole 20*a*; 23*d* is a second valve stopper formed adjacent to the second valve support 23*b* opposite to the first valve support 23*c* and having an outer diameter larger than the second valve support 23*b* but smaller than the first valve support 23*c*; and 23*e* is a first valve stopper formed near the distal end side of the first valve support 23*c* and having an outer diameter larger than the first valve support 23*c*. These members, including the first valve seat 22 and second valve seat 21, are formed by skiving for precise assembly. In this case, both the first valve seat 22 and the second valve seat 21 are formed in a disc-like shape, and the outer diameter of first valve seat 22 is larger than that of the second valve seat 21.

At first, the main movable shaft 23*a* is inserted in the first through hole 20*a* until until the first closing valve 20 contacts with the first valve stopper 23*e*, and the first closing valve 20 is fitted around the first valve support 23*c* by press fitting it over the support 23*c*. In that state, one end of first valve support 23*c* opposite to the second valve support 23*b* is caulked to fix the first closure valve 20 on the movable shaft 23. After the insertion of the first valve seat 22, the main movable shaft 23*a* is inserted in the second through hole 19*a* until the second closure valve 19 contacts with the second valve stopper 23*d* and the second closure valve 19 is fitted around the second valve support 23*b* by press fitting it over the support 23*b*. In that state, the end portion of second valve support 23*b* opposite to the first valve support 23*c* is caulked to fix the second closing valve 19 on the movable shaft 23.

Figure 9A:
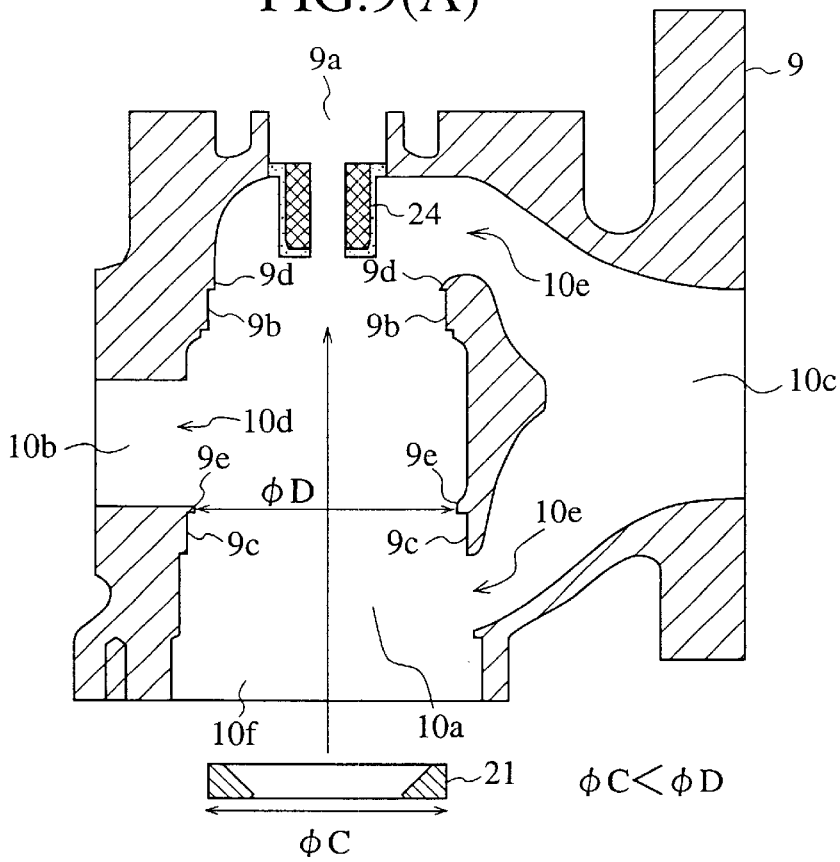
FIG. 9 is a diagram showing a process of assembling a housing in embodiment 1 according to the present invention.
Figure 9B:
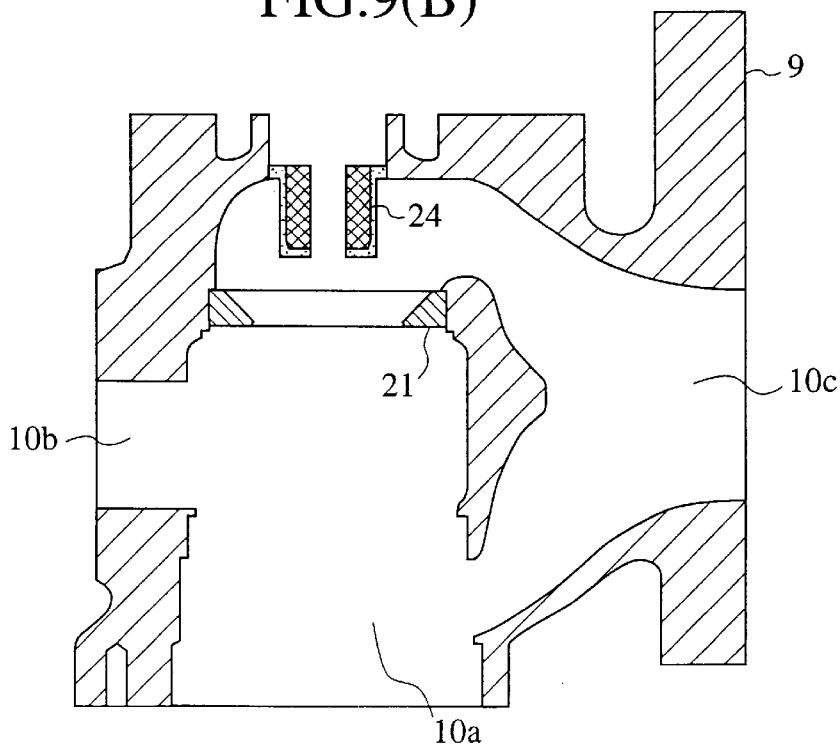
Figure 10C:
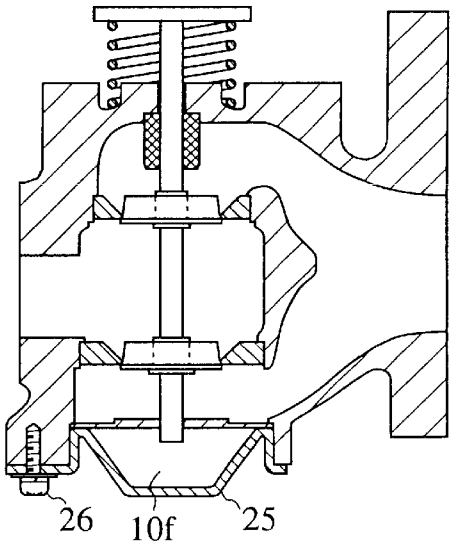
FIG. 10 is another diagram showing a process of assembling a housing in embodiment 1 according to the present invention.
Figure 10B:
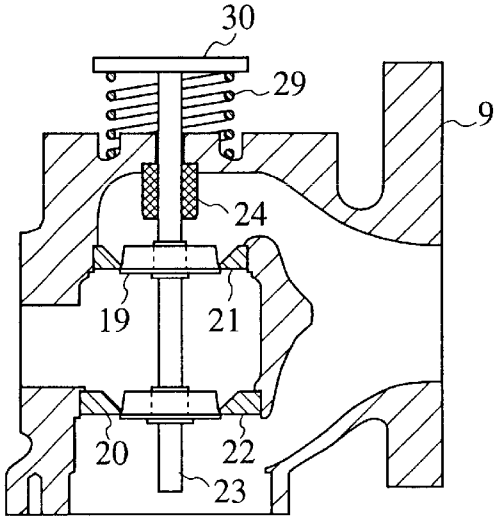
Figure 10A:
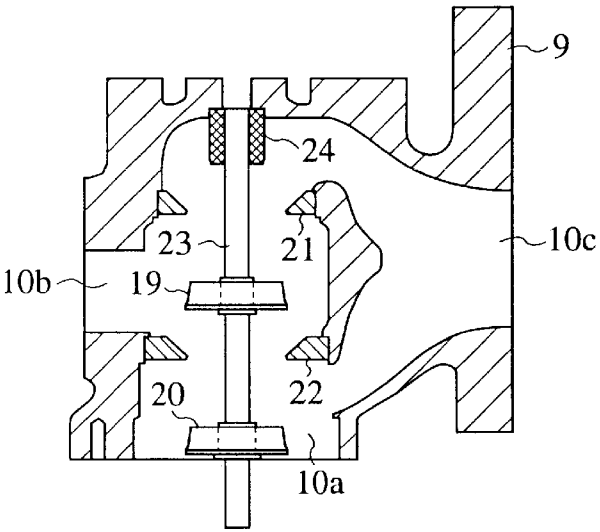

FIG. 9 and FIG. 10 respectively show processes for assembling the housing in embodiment 1 of the present invention, wherein FIG. 9(*a*) is a partly exploded cross section, FIG. 9(*b*) and FIGS. 10(*a*) to 10(*c*) are cross sections respectively showing the assembling steps. In the drawings, numeral 9*b* designates a second valve seat fitting disposed in the movable space 10*a* between the inlet opening 10*e* near the through hole 9*a* and the other inlet opening 10*d* to be just fitted around the outer periphery of the second valve seat 21; 9*d* is a second valve seat stopper located adjacent one end of the second valve seat fitting 9*b* opposite to the through hole 9*a* and projecting more inwardly to the movable space 10*a* than the second valve seat fitting 9*b*; 9*c* is a first valve seat fitting portion provided in the movable space 10*a* between the openings 10*e* and opening 10*d* near the assembly hole 10*f* and is fitted around the outer periphery of first valve seat 22, and 9*e* is a first valve seat stopper disposed adjacent one end of the first valve seat fitting portion 9*c* near the second valve seat fitting portion 9*b* and projecting more inwardly to the movable space 10*a* than the first valve seat fitting 9*c* formed with a greater inner radius than the second valve fitting 9*b*. In this embodiment 1, the housing 9 is formed by casting, and it is preferred to use iron or stainless steel as the material for the casting in a diesel engine rather than aluminum because aluminum tends to be corroded by exhaust gas.

The second valve seat 21 is inserted in the movable space 10*a* from the assembly hole 10*f* and is fitted in the second valve fitting 9*b* until it is in abutment with the second valve seat stopper 9*d*. In that state, one end of the second valve fitting 9*b* near the assembly hole 10*f* is caulked to fix the second valve seat 21 in the housing 9 (see FIG. 9(*b*). The movable member assembled as described above is then inserted into the movable space 10*a* from the assembly hole 10*f* until the first valve seat 22 is in contact with the first valve seat stopper 9*e* while press fitting the first valve seat 22 in the first valve fitting portion 9*c*. One end portion of the first valve seat fitting portion 9*c* near the assembly hole 10*f* is caulked to fix the first valve seat 22 in the housing 9 (see FIG. 10(*a*). After projecting the movable shaft 23 from the through hole 9*a*, the spring support seat 30 is secured to the projected distal end of the movable shaft 23 with the coil spring 29 being compressed between the spring support seat 30 and the housing 9 (see FIG. 10(*b*). Finally, the assembly hole 10*f* is covered with the assembly hole closing member 25, and the assembly hole closing member 25 is secured to the housing 9 by the screw 26 (see FIG. 10(*c*). Thus the assembly of the exhaust gas re-circulation system 8 is completed by mounting the spacer 27 and stepping motor 17 on the housing 9, respectively (see FIG. 4).

As stated above, the exhaust gas re-circulation system 8 of embodiment 1 is constructed by separately forming and then assembling together the housing 9 and two valve seats 21, 22. In this case, the housing 9 can be easily formed by casting, and the valve seats 21, 22 can be obtained with good precision by skiving. Therefore, the present invention enables the provision of an exhaust gas re-circulation system having desired closing-valve properties.

In addition, since the two valve seats 21, 22 are formed separately from the housing 9 before assembling them together, the inner diameters of the two valve seats 21, 22 are conformable with high accuracy. Further, by appropriately selecting the order of mounting the two valve seats 21, 22 and of mounting the closure valves 19, 20, the external diameters of two closure valves 19, 20 are accurately conformable with each other. Therefore, the effect of canceling the exhaust gas pressure due to the two closure valves 19, 20 can be maximized.

Many essential steps of assembling the whole system can be carried out by press fitting and caulking, thereby to facilitating the assembly work. Moreover, this assembly can reduce assembling parts such as bolts or the like in number, whereby the manufacturing cost can be also reduced.

Though the employment of double valves in a stepping motor type system has been described in the above embodiment, the present invention is also applicable to the diaphragm type system. As a result, in particular, the change in valve opening degree due to pulsation of exhaust gas can be prevented.

INDUSTRIAL FIELD OF UTIIZATION

As stated above, the exhaust gas re-circulation system according to the present invention is suitable for effecting exhaust gas re-circulating operation with high accuracy even when used with diesel turbo-type engines from which considerably high pressure exhaust gas is generated.

What is claimed is:

1. An exhaust gas recirculation system including:

a recirculation system main body which can be disposed in a recirculation path for exhaust gas, a movable member on which two closure valves are formed, a movable space comprising an area formed inside the recirculation system main body in which the movable member is disposed movably, a first recirculation hole formed to communicate with a central portion of the movable space through an outer face of the recirculation system main body, second and third recirculation holes formed to communicate with both ends of the movable space through another outer face of the recirculation system main body than in the case of the first recirculation hole, and two valve seats each of which is in abutment with each of the closure valves when the movable member is located at a preset position in the movable space and which communicate between the central portion and both end portions of the movable space, wherein a first movable space opening formed by the communication of the first recirculation hole with the movable space is formed outside the movable range of the closure valves in the movable space.

2. An exhaust gas recirculation system according to claim 1, wherein the movable member is controlled by a motor.

3. An exhaust gas recirculation system according to claim 1, wherein the exhaust gas flows into the system from the first recirculation hole, the movable member has a movable shaft extending through the gas recirculation system main body, two closure valves are fixed on the movable shaft, and a bearing for the movable shaft is provided on one or both ends of the movable shaft outside the closure valves.

4. An exhaust gas recirculation system according to claim 1, wherein the recirculation system main body comprises a housing in which an assembly hole of a size larger than the outer diameters of the two valve seats is formed at one end of the movable space, and an assembly hole closing member for closing the assembly hole, the valve seat of the two valve seats which is nearer to the assembly hole having a size larger than the size of the other one farther from the assembly hole.

5. An exhaust gas recirculation system according to claim 1, wherein exhaust gas pressure effects the two closure valves evenly in opposite directions regardless of a degree of opening of said closure valves.

6. An exhaust gas recirculation system including:

a recirculation system main body which can be disposed in a recirculation path for exhaust gas, a movable member on which two closure valves are formed, a movable space comprising an area formed inside the recirculation system main body in which the movable member is disposed movably, a first recirculation hole formed to communicate with a central portion of the movable space through an outer face of the recirculation system main body, second and third recirculation holes formed to communicate with both ends of the movable space through another outer face of the recirculation system main body than in the case of the first recirculation hole, and two valve seats each of which is in abutment with each of the closure valves when the movable member is located at a preset position in the movable space and which communicate between the central portion and both end portions of the movable space, wherein each of the two valves is moved in a range which does not overlap with a first movable space opening formed by the communication of the first recirculation hole with the movable space.

7. An exhaust gas recirculation system according to claim 6, wherein the exhaust gas flows into the system from the first recirculation hole, the movable member has a movable shaft extending through the gas recirculation system main body, two closure valves are fixed on the movable shaft, and a bearing for the movable shaft is provided on one or both ends of the movable shaft outside the closure valves.

8. An exhaust gas recirculation system according to claim 6, wherein the recirculation system main body comprises a housing in which an assembly hole of a size larger than the outer diameters of the two valve seats is formed at one end of the movable space, and an assembly hole closing member for closing the assembly hole, the valve seat of the two valve seats which is nearer to the assembly hole having a size larger than the size of the other one farther from the assembly hole.

9. An exhaust gas recirculation system according to claim 6, wherein exhaust gas pressure effects the two closure valves evenly in opposite directions regardless of a degree of opening of said closure valves.

10. An exhaust gas recirculation system according to claim 6, wherein the movable member is controlled by a motor.

11. An exhaust gas recirculation system according to claim 10, wherein said motor is a stepping motor.

12. An exhaust gas recirculation system according to claim 11, wherein said shaft moves in accordance with movement of a rotor of said stepping motor, such that a degree of opening of said closure valves can be controlled.

13. An exhaust gas recirculation system according to claim 12, such that the degree of opening of said closure valves depends upon at least one of an engine speed, pressure of an intake line, and coolant temperature.

14. An exhaust gas recirculation system comprising:

a main body encased in a housing, including a movable space;

a shaft movably disposed in said movable space, upon which two closure valves are fixed;

two valve seats each of which is in abutment with one of said two closure valves when the shaft is located at a preset position in the movable space, said two valve seats communicating between a central portion and an upper and lower portion, respectively, of said movable space;

a first hole in said housing communicating between an exhaust gas intake line and the central portion of said movable space;

second and third holes in said shousing communicating between an exhaust gas recirculation line and the upper and lower portion, respectively, of the movable space;

and a motor fixed to said housing and connected to said shaft for controlling movement of the shaft;

wherein the movable range of either of said two closure valves is disposed outside of a first movable space opening formed by the communication of the first hole with the movable space.

15. An exhaust gas recirculation system according to claim 14, wherein exhaust gas pressure effects the two closure valves evenly in opposite directions regardless of a degree of opening of said closure valves.

16. An exhaust gas recirculation system according to claim 14, wherein said motor is a stepping motor.

17. An exhaust gas recirculation system according to claim 16, wherein said shaft moves in accordance with movement of a rotor of said stepping motor, such that a degree of opening of said closure valves can be controlled.

18. An exhaust gas recirculation system according to claim 17, such that the degree of opening of said closure valves depends upon at least one of an engine speed, pressure of an intake line, and coolant temperature.

19. An exhaust gas recirculation system according to claim 2, wherein said motor is a stepping motor.

20. An exhaust gas recirculation system according to claim 19, wherein said shaft moves in accordance with movement of a rotor of said stepping motor, such that a degree of opening of said closure valves can be controlled.

21. An exhaust gas recirculation system according to claim 20, such that the degree of opening of said closure valves depends upon at least one of an engine speed, pressure of an intake line, and coolant temperature.

* * * * *